United States Patent [19]

Stouffer

[11] Patent Number: 4,562,867

[45] Date of Patent: Jan. 7, 1986

[54] FLUID OSCILLATOR

[75] Inventor: Ronald D. Stouffer, Silver Spring, Md.

[73] Assignee: Bowles Fluidics Corporation, Columbia, Md.

[21] Appl. No.: 960,195

[22] Filed: Nov. 13, 1978

[51] Int. Cl.[4] ..... B05B 1/08

[52] U.S. Cl. ..... 137/811; 137/826; 137/8.35; 137/838; 239/DIG. 3

[58] Field of Search ..... 137/811, 826, 834, 835, 137/838, 839; 239/102, DIG. 3

[56] References Cited

U.S. PATENT DOCUMENTS

| | | | |
|---|---|---|---|
| Re. 27,938 | 3/1974 | Bauer | 239/456 X |
| 3,181,545 | 5/1965 | Murphy, Jr. | 137/838 |
| 3,432,102 | 3/1969 | Turner et al. | 137/835 X |
| 3,434,487 | 3/1969 | Bauer | 137/835 |
| 3,512,557 | 5/1970 | Brear | 137/811 |
| 3,820,716 | 6/1974 | Bauer | 137/829 X |
| 3,998,386 | 12/1976 | Viets et al. | 137/813 X |
| 4,052,002 | 10/1977 | Stouffer et al. | 137/835 X |
| 4,151,955 | 5/1979 | Stouffer | 137/835 |
| 4,184,636 | 1/1980 | Bauer | 137/809 X |

*Primary Examiner*—A. Michael Chambers
*Attorney, Agent, or Firm*—Zegeer, Jim

[57] ABSTRACT

There is disclosed a fluidic oscillator in which a stream of fluid is directed against a barrier member in an oscillation chamber. The barrier member serves as one wall of the oscillation chamber and in conjunction with other shaped wall surfaces of the oscillation chamber creates a pair of alternately pulsating control vortices for causing the fluid in the power stream to pass alternately to a pair of outlet passages. The vortices alternate both in strength and in a phase opposition to control flow of the jet stream in alternate fashion through the outlet passages. In a preferred embodiment of the invention, the pair of outlet passages are on opposite sides of the barrier member and converge to a common outlet to thereby provide a fan spray as the outlet passages alternate in the passage of the stream of fluid therethrough to the common outlet.

10 Claims, 1 Drawing Figure

FIG 1
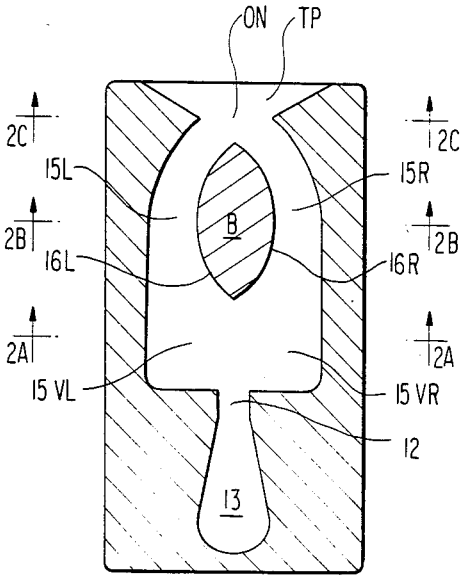
FIG 2A
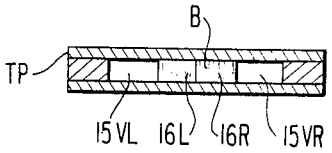
FIG 2B
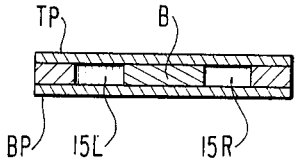
FIG 2C
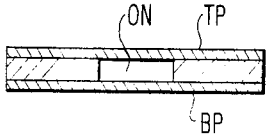
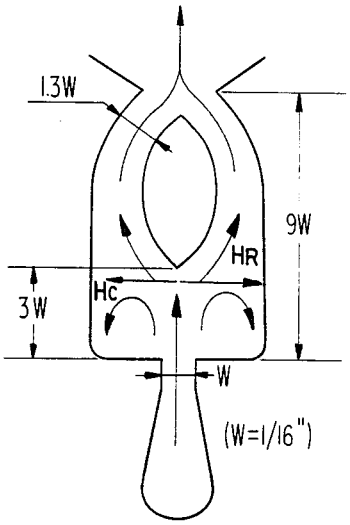
FIG 3A
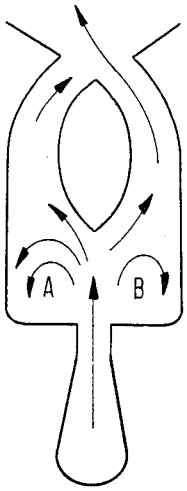
FIG 3B
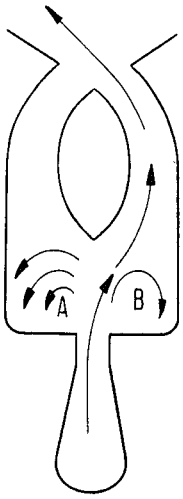
FIG 3C
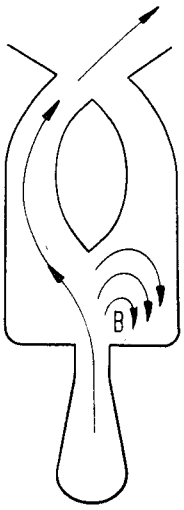
FIG 3D
(EXEMPLARY PROPORTIONS ILLUSTRATED)

FLUID OSCILLATOR

DESCRIPTION

Background of the Invention

This invention relates to a fluidic oscillator which oscillations are initiated and sustained without external controls, at a relatively low threshold or pressure and without any moving parts so that it constitutes a free running oscillator. In the prior art, such oscillators depended upon the wall lock (coanda) effect and the induction of ambient air (in the case of a liquid power jet) for causing oscillations which, inherently, depends upon conditions external of the device to determine its operating parameters. In U.S. Pat. No. 3,226,508, for example, such a free and running oscillator is disclosed in which a straight pair of parallel side walls are alternately utilized for wall attachment purposes. A semi-circular wall connects the two straight walls to form a continuous planar surface and air from the surrounding atmosphere flowing back along the opposite wall to the semi-circular back side to form a low pressure area on the back side of a dam member behind the fluid supply. The in-flowing air in addition to neutralizing a pressure differential between both sides of the power stream upsets conditions of stability in the opposite adjacent control area to cause the power stream to detach from the first wall and to switch over and attach to the second wall where the process repeats itself. A barrier is utilized to control the oscillation frequency of the device by the size of ambient air inlet openings and thereby influence the quantity of air that may enter the device per unit time.

U.S. Pat. No. 3,434,487, discloses (in FIG. 6 thereof) a power jet stream projected to a splitter. Formed on each side of the splitter are peel off cusp regions which intersect the walls defining the output passages on each side of the splitter. The cusp forming regions not being vented to the atmosphere or other stable pressure source, causes the device to operate as a boundary layer unit. When the power stream is diverted towards the side of the apparatus on which a particular cusp is located, that cusp peels off a portion of the power stream which diverted portion is caused to flow back to the nozzle for the power jet stream as a feedback signal to project against the stream so that, in the fashion of momentum transfer control signal jets, the stream is deflected to the opposite side of the splitter where the second cusp and its side walls peel off a portion of the stream operated in the same manner. U.S. Pat. No. 3,434,487 characterizes this as a pure fluid oscillator of the "double" lobe type and its purpose is to provide small amplitude, high frequency oscillations (of about 100 kilohertz) to maintain the power stream oscillating upon the pointed apex end of the splitter so that at the center of the bistable device so that control jets streams may be used and more easily control the one or the other bistable states, and the bistable device has maximum gain.

It is also known that when a stream of fluid issues from a nozzle and impinges upon a wedge (a splitter) as disclosed in the above U.S. Pat. No. 3,434,487, it produces vortices at the wedge (see B. Brown, Precedings of Physical Society of London, Vol. 49 at page 493, 1933). These vortices propagate back to the nozzle orifice forcing the jet to oscillate transverse to the direction of flow. The oscillations are referred to as edge tone or wedge tone oscillations.

DESCRIPTION OF THE INVENTION

According to the present invention, an interaction or oscillation chamber is formed into which is introduced, from a power nozzle or a jet, a stream of fluid under pressure, such as a liquid, which is caused to impinge upon a barrier or far wall of the chamber. Vortex forming means are formed in the chamber, primarily by the side walls of the chamber coacting with the barrier surfaces. These vortices, sometimes hereinafter designated as control vortices, alternately pulsate to serve as the predominant mechanism for sustaining oscillation.

With the power jet being directed initially to impinge upon the barrier, the stream divides roughly into two equal streams which, in a preferred embodiment of the invention, are caused to reconverge as one stream as they exit the device. If the power stream deflects to the right of the barrier by reason of some perturbation in the device, more energy is delivered to the vortex on the right side of the stream which, as the stream deflects more and more to the right builds up greater and greater energy and, since one side of the vortex is bounded by fluid of the power stream and the opposite side is bounded by the vortex forming wall of the oscillation chamber, the vortex can only grow in a direction to shut off the power stream and its exit from the oscillation chamber and switches it to the opposite side of the barrier member and begins to feed energy to the left vortex. In each case, the vortex is formed in the active side or corner and, in the preferred embodiment of the invention, prevents wall attachment; and as the vortex grows on one side in strength and diminishes in strength on the opposite side (because of the less fluid feed thereto to sustain the vortex), there is a shift. Hence, with reference to the barrier induced oscillation, the upstream vortices are characterized by low frequency pulsations in the fluid issuing from the outlet of the device (as compared to downstream or shed vortices which are characterized by high frequency oscillations which may be superimposed on the low frequencies pulsations or oscillations). These oscillations are manifested by pulsations in the fluid stream and readily discernable under a strobe light. In a preferred embodiment, the two outlet passages reconverge so that the fluid stream which is exiting from the device is the same amount of fluid which enters through the power nozzle but it is deflected or swept in a fan-like pattern.

The above and other objects, advantages and features of the invention will become more apparent from the following description taken in conjunction with the the accompanying drawings wherein:

BRIEF DESCRIPTION OF THE DRAWINGS

FIG. 1 illustrates one preferred embodiment of the invention.

FIG. 2A is a cross-sectional view of lines 2A—2A of FIG. 1, FIG. 2B is a cross-sectional view of lines 2B—2B of FIG. 1, FIG. 2C is a cross-sectional view of lines 2C—2C of FIG. 1.

FIGS. 3A–3D are further illustrations helpful in understanding the basic principle of operation of the invention.

In reference to FIG. 1, the basic oscillator is illustrated in silhouette from having a bottom plate BP, a top plate TP, the top plate TP and the bottom plate BP defining the space or boundaries between the silhouetted outline of the oscillator (the terms "top" and "bottom" are terms of reference with respect to the drawings and are not intended to be limiting terms). The oscillator includes a power nozzle 12 which receives a supply of fluid under pressure from supply 13. At any rate, the nozzle 12 defines an inlet passage means into the oscillation chamber 15. A barrier member B has wall surfaces 16L and 16R which constitute a part of the oscillation chamber walls. The barrier member is in the path of the power stream or jet stream of fluid issuing from nozzle 12 and forms, with the oscillation chamber 15, left and right vortex forming sections 15VL and 15VR, respectfully. A pair of outlet passages or openings 15L and 15R are formed to the left and right, respectively, of barrier member B. In this embodiment, the barrier member B comprises the far wall of the oscillation chamber remote from the inlet opening or nozzle 12 and while shown as having an apical end, the end could be flat. The outlet passages 15L and 15R are curved around barrier member B so as to reconverge in outlet nozzle ON. As will be described hereinafter in connection with the operation of the device, the fluid issuing from the outlet nozzle ON oscillates in a fan shape pattern and at a frequency determined by the geometrical dimensions of the device, the pressure and viscosity of the working fluid. However, a feature of the invention is that the threshold of oscillation of the device is at a relatively low pressure.

Upon receiving pressurized fluid from source 13, the nozzle 12 projects a power stream of fluid through nozzle opening 12 into oscillation chamber 15 whereupon the fluid impinges initially on the directly opposing or far wall of the oscillation chamber 15, which in this embodiment is constituted by the surfaces 16L and 16R of barrier member B. This impinging stream of fluid divides into two streams (FIG. 3A) which flow to opposite sides of the barrier member B and hence are oppositely directed flows, and these flows follow the contour of chamber 15 via the outlet passages 15L and 15R and egress through these outlet passages on opposite sides of the barrier member B. Left and right horizontal (in a vectorial sense) or lateral components of flow are indicated by arrows $H_L$ and $H_R$. The two flow components on opposite sides of the barrier member B forms vortex A and vortex B in vortices forming area 15VL and 15VR. This condition of equal flow in outlet passages 15L and 15R to each side of barrier B which is illustrated in FIG. 4*a*, is highly unstable and, due to some perturbation in the chamber the left vortex A, for example, predominates initially and gets stronger as the fluid flow in vortex B gets large it enlarges and more and more of the fluid of the jet flow is delivered to the vortex, in 15VL. Since the vortices are constrained by the physical wall of the oscillation chamber, they expand to block the outlet passages 15L and 15R, respectively. In the disclosed embodiment, the vortex A in 15VL has counter clockwise fluid flow whereas the vortex B in 15VR has clockwise fluid flow and this will always be the direction of the fluid flow in the vortices in this configuration. However, it will be appreciated that the device may be reoriented so as to have the vortex forming sections 15VL and 15VR on the right and left sides of the power jet relative to nozzle 12, e.g., reverse the positions of the barrier B and the power nozzle 12. In such embodiment, the inlet and outlets would be formed in a common side of the oscillation chamber.

The vortex A in the meantime tends to be crowded towards the outlet passsage 15L and prevents less of the input fluid to flow through passage 15L. Eventually as illustrated in FIG. 3*c*, left vortex A has grown large and the center thereof, due to the constraint by the wall of the vortex forming section 15VL moves, outwardly into the power flowing through passage 15L to block same, and the vortex B is constrained to move closer to the wall of vortex forming section 15VR. As vortex A on the left side is forced closer and closer to the outlet passage 15VL, two things occur: vortex A shuts off outflow through outlet passage 15L and it also moves substantially closer to the mouth of the passage 15L. In this condition vortex A receives fluid flowing at a much higher velocity than the fluid received by vortex B and therefore vortex A moves closer to the outlet passage and begins spinning faster and has much greater energy than vortex B. The outlet passage 15L is blocked and vortex A begins moving back toward the center of chamber 15 and in doing so forces the slower spinning or lower energy vortex B back away from the center. This tendency is increased by the fact that the jet itself is issued towards the center of the chamber 15 and as the vortices approach the condition illustrated in FIG. 3B, vortex A is stronger or dominates and continues to grow, being forced by the physical constraint by the side walls of oscillation chamber in area 15L to move towards the center of chamber 15 and block outlet passage 15VL (See FIG. 3C). Vortex B now receives the high velocity fluid from the in flowing jet from nozzle 12 and it begins spinning faster and faster taking on a position of dominance between the two vortices. It likewise, as it grows is constrained by the right wall 15VR but has only the constraint of fluid stream of issuing from nozzle 12 on the left side thereof, and accordingly, it moves to shut off outlet passage 15R. Thus, vortex B moves closer towards the center of the chamber 15 and more and more fluid begins to exit through outlet passage 15L (See FIG. 3D). The cycle is complete when the two control vortices achieve the position illustrated in FIG. 3A once again with equal flow through outlet passages 15L and 15R. The cycle then repeats in the manner described.

Summarizing, initial flow of the fluid jet from nozzle 12 into oscillation chamber 15 produces a straight flow across the chamber which splits into two loops upon impingement upon the far wall or barrier member B in the oscillation chamber. Vortices are formed in vortex forming chamber sections 15VL and 15VR by virtue of the fluid flowing through the two passage 15L and 15R on each side of barrier member B and the lateral component of fluid flow the vortex A formed in 15VL rotating counter clockwise and the vortex B formed in vortex chamber 15VR rotating clockwise. The resulting unstable balance between the two vortices on either side of the flow issuing from nozzle or inlet opening 12 cannot sustain the momentary initial condition of flow to each side of the barrier B. It should be noted that the surfaces 16L and 16R to the left and right side of the barrier B have fluid flow which have vectorial components which are in effect, reverse to one another. That is to say, there is a horizontal (in a vectorial sense) component $H_L$ of fluid flow to the left side of barrier B caused by surface 16L which is directed to the left of the barrier B and there is horizontal component $H_R$ of flow to the right due to the surface 16R which is directed to the right. These two components are thus reversed flow loops, each of which, in conjunction with the main power stream flow issuing from nozzle 12 serves to create powerful control vortices A and B as described earlier. These flows cause one or the other of the vortices to gain strength and the other to get weaker to deflect the jet toward the side with the weaker reverse flow which further enhances the action of the phenomena. In other words, a positive feedback effect is present and it causes the flow exiting from the chamber to veer toward one side of the chamber until new balance of vortices is reached. It must be recognized that the occurring phenomenas are inherently of a transient dynamic nature such that any flow conditions are of a quasi steady state nature wherein one of the existing flow patterns represent a stable state; that is, the flow in any location is dependent upon its prior history due to the fact that the local flow states influence, and are influence, by those flow states in other locations after delay of time.

Even though the stronger of the two existing vortices A abd B appear capable of sustaining the illustrated flow patterns at any point, the quasi steady state affect the flow into one or more of the output channels 15L and 15R causes the pattern in the chamber to become more symmetrical.

Outlet flow passages 15L and 15R are caused to curve and converge to an outlet ON designated as an outlet nozzle. Any initial condition described earlier herein when the fluid to the left and right side of barrier B is substantially equal, this fluid reconverges and the stream issues approximately along the center line of the barrier B. When one or the other vortices prevails, and the left or the right side is shut off with fluid flowing through the opposite side by virtue of the reconvergence through outlet nozzle ON and the shutting off effect of the opposite passage. The crossing over of the power stream to the right and left and side of the barrier member to exit from the oscillation chamber through nozzle outlet ON is preferably done in a full fluid state that is to say, the working fluid issuing from nozzle 12 completely fills oscillation chamber 15 and the outlet passages 15L and 15R and prevents or limits the induction of ambient fluid, such as air.

An important advangage of the invention over the prior art is that its threshold pressure before oscillation are can be initialed is quite low and the operating frequency can be quite low. Moreover, the vortices formed herein substantially shut off complete fluid flow through the right and left channel. By virtue of their being in position between the wall defining the vortex forming chamber 15VL and 15VR prevent wall attachment or the coanda effect and, in fact, it is not necessary for an attachment to be existing at the barrier or island B since it is the outer wall contour to deflect the stream to effect cross over. The basic operation is that each passage 15L and 15R actively shares the duty of an active flow passage and that is shut off by virtue of the alternately pulsating vortices formed in the inlets passages 15L and 15R.

While I have disclosed preferred embodiment of the invention, it will be appreciated by those skilled in the art that various modifications and changes may be made thereto without departing from the spirit and scope of the invention as defined in the claims appended hereto.

I claim:

1. A fluidic oscillator comprising, (a) an oscillation chamber;

(b) an inlet passage means in said chamber for introducing a power stream therein and a pair of outlet passage means from said chamber from which exits all of the fluid introduced into said chamber by said power stream, (c) said chamber including a barrier member in the path of said power stream, (d) said chamber having surfaces adapted to create alternately pulsating control vortices for causing the fluid in said power stream to pass alternately through said pair of outlet passages.

2. The invention defined in claim 1 wherein said barrier member is at least in part a portion of a wall of said oscillation chamber.

3. The fluidic oscillator defined in claim 1 wherein said vortices are between the walls of said chamber and said power stream.

4. The invention defined in claim 1 wherein said pair of outlet passage means are on the opposite sides of said barrier member.

5. The invention defined in claim 4 wherein said pair of outlet passage means are downstream of said barrier member and said control vortices are formed upstream of said barrier member.

6. A fluidic oscillator comprising in combination a power nozzle for issuing a stream of fluid under pressure, a barrier member in the path of said fluid stream for temporarily dividing said fluid stream into a pair of secondary fluid streams, a closed surface including as a part thereof the surface of said barrier member, said closed surface having means for forming a pair of control vortices to each side of said power stream, respectively, to alternately pulsate and control the direction of fluid flow with respect to said barrier means, and a pair of outlet means through which said fluid stream alternately pass.

7. The invention defined in claim 6 wherein said pair of outlet means converge to a common outlet.

8. The invention defined in claim 7 wherein the axis of each of said pair of outlet means cross each other and the fluid issuing from said common outlet defines a fan shaped pattern.

9. A fluid oscillator device comprising:

a body member having a chamber therein, means for introducing a constant stream of fluid under pressure into said chamber means in said chamber for creating at least a pulsating pair of alternately opposite rotating wall attachment preventing vortices in said chamber, a pair of outlet passage means connecting the interior of said chamber to the exterior of said body member, each vortex of said pair of wall attachment preventing votices controlling the flow of said stream of fluid through one of said pair of outlet passage means, respectively.

10. A fluid oscillator comprising:

nozzle means for forming and issuing a jet of fluid in response to application thereto of fluid under pressure;

an oscillation chamber having means forming inlet and outlet openings therein, said oscillation chamber being positioned to receive said jet of fluid from said nozzle means through said inlet opening, said oscillation chamber including:

oscillation means within said chamber for cyclically oscillating said jet back and forth across said chamber in a direction substantially transverse to the direction of flow in said jet, said oscillation means including impingement means disposed in said oscillation chamber in the path of said jet, for forming, on each side of said jet, vortices of said jet of fluid which alternate in both strength and chamber position in phase opposition, said impingement means comprising a far wall of said chamber remote from said inlet opening; flow directing means for directing fluid from the cyclically oscillated jet out of said chamber through means forming a pair of outlet passages leading to said outlet opening, said nozzle means being positioned to issue said jet generally radially across said oscillation chamber towards said impingement means, said outlet passages being defined as spaces between opposing walls of said chamber and said far wall, and said inlet opening, said means forming said outlet opening being constituted by a first of said pair of outlet passages positioned at one side of said nozzle means to receive fluid flowing to said outlet opening along said one side of said jet, and a second of said pair of outlet passage positioned at the opposite side of said nozzle means to receive fluid flowing to said outlet opening along the opposite side of said jet.

* * * * *